US005452526A

United States Patent [19]

Collins

[11] Patent Number: 5,452,526

[45] Date of Patent: Sep. 26, 1995

[54] FOOTWEAR HAVING AN OUTSOLE STIFFENER

[75] Inventor: David R. Collins, Lichfield, England

[73] Assignee: Trisport Limited, Staffordshire, England

[21] Appl. No.: 173,151

[22] Filed: Dec. 22, 1993

Related U.S. Application Data

[63] Continuation of Ser. No. 849,426, filed as PCT/GB90/01953, Dec. 14, 1990, abandoned.

[30] Foreign Application Priority Data

Dec. 15, 1989 [GB] United Kingdom ..... 8928391

[51] Int. Cl.[6] ..... A43B 13/42

[52] U.S. Cl. ..... 36/76 R; 36/108

[58] Field of Search ..... 36/76 R, 107, 36/108, 88, 91, 103, 25 R, 27, 30 R, 72 A, 73, 75 R, 145, 148

[56] References Cited

U.S. PATENT DOCUMENTS

| | | | |
|---|---|---|---|
| 903,276 | 11/1908 | Edman | 36/108 |
| 1,039,518 | 9/1912 | Golden | 36/108 |
| 1,746,010 | 2/1930 | Nickerson | 36/76 R |
| 2,070,269 | 2/1937 | Goldenberg | 36/108 |
| 2,221,430 | 11/1990 | Nickerson | 36/76 R |
| 2,284,830 | 6/1942 | Lyness | 36/76 R |
| 2,322,297 | 6/1943 | Jalbert | 36/108 |
| 2,342,466 | 2/1944 | Gordon | 36/76 R |
| 2,403,950 | 7/1946 | Rosenthal | 36/76 R |
| 4,246,708 | 1/1981 | Gladek | 36/107 |
| 4,766,680 | 8/1988 | Maciel et al. | 36/87 |
| 4,845,863 | 7/1989 | Yung-Mao | 36/114 |
| 4,858,338 | 8/1989 | Schmid . | |
| 4,922,631 | 5/1990 | Anderié | 36/76 R |

FOREIGN PATENT DOCUMENTS

| | | |
|---|---|---|
| 2022974 | 11/1971 | Germany . |
| 8807671 | 8/1988 | Germany . |
| 246465 | 10/1947 | Switzerland . |
| 1101097 | 1/1968 | United Kingdom . |

*Primary Examiner*—Paul T. Sewell
*Assistant Examiner*—Thomas P. Hilliard
*Attorney, Agent, or Firm*—Schweitzer Cornman & Gross

[57] ABSTRACT

An article of footwear, such as a soccer boot (1) or training shoe has a sole (5) incorporating a stiffener (8;22,23) . The stiffener comprises a first portion (10;22) which stiffens the waist or shank of the sole and so resists transverse flexure, and a second portion (11;23) which both stiffens the fore-part of the sole and provides resilience to cause or assist in returning the fore-part of the sole to its original shape after it has been subjected, in use, to transverse flexure as the result of flexure of the wearer's foot at the ball of the foot. The stiffness of the second portion is less than the stiffness of the first portion. The stiffening (8) may be formed as a unitary body, with the forward end of the first portion integral with or united with the rear end of the second portion.

6 Claims, 3 Drawing Sheets

FOOTWEAR HAVING AN OUTSOLE STIFFENER

RELATED APPLICATIONS

This application is a continuation of my prior application Ser. No. 07/849,426, filed as PCT/GB90/01953, Dec. 14, 1990, now abandoned.

BACKGROUND AND SUMMARY OF INVENTION

This invention relates to articles of footwear and is particularly concerned with improvements in the soles of articles of footwear. The term sole is used herein to denote a part of an article of footwear which in use extends beneath at least the instep of the foot of the user and beneath the fore-part of the foot. As will become apparent from what follows, some of the soles to which the improvements are applied also extend rearwards so that in use they are situated beneath the user's heel.

That part of an article of footwear which in use extends beneath the instep of the foot is often referred to as the waist or shank. As the waist or shank is usually narrower than the heel and the fore-part, it tends to be the least stiff part of the sole so that in use, when the user is walking, it tends to flex transversely more readily than the fore-part or the heel. This tends to be uncomfortable for the user, and to overcome or reduce that difficulty it has been common practice for many years to incorporate in some types of footwear a shank-stiffener in the waist or shank, a typical form of shank-stiffener comprising a flexible and resilient strip of metal extending lengthwise of the waist or shank.

While the use of a shank-stiffener is often satisfactory in walking shoes, which generally have rigid heels and have soles of which the fore-parts made of materials such as leather that have a significant degree of inherent stiffness, the use of a shank-stiffener in that way may well be less satisfactory in articles of footwear of other kinds, and in particular in articles of footwear having soles that are relatively thin and are made of materials, such as some plastics materials, that have little inherent stiffness and resilience. Articles of footwear used in certain sports and games have soles of that kind. The provision of a shank-stiffener in a sole of that kind could well lead to problems for although it would reduce the tendency of the relatively narrow waist or shank to flex too readily, it would lead to a tendency for the sole to bend in a zone immediately forward of the shank-stiffener and would thus be likely to be uncomfortable in use.

The present invention was primarily developed to provide a sole so designed and constructed as to overcome or reduce problems of that kind, but as will become apparent from what follows, the present invention is of more general application than that. As used herein, the term "sole" shall refer to an "outsole", i.e. that portion of the sole below the shoe upper and to which the upper is directly secured, unless the context clearly indicates otherwise.

From one aspect the present invention consists in a sole (as hereinbefore defined) for an article of footwear characterised in that it incorporates stiffening means comprising a first portion operative to stiffen the waist or shank of the sole and a second portion operative both to stiffen the fore-part of the sole, though to a lesser extent than the first portion stiffens the waist or shank, and to provide resilience to cause or assist in the return of the fore-part of the sole to or towards an unflexed state after being subjected, in use, to transverse flexure as the result of flexure of the user's foot at the ball of the foot.

From a second aspect the present invention consists in an article of footwear incorporating a sole which is in accordance with the first aspect of the present invention.

A sole embodying the present invention differs from those previously provided in that it can have, throughout substantially its entire length, physical properties which are selected so as to be both appropriate to the use to which the sole is to be put and comfortable for the user. In particular, the first portion of the stiffening means reduces or overcomes the inherent tendency in most articles of footwear for the waist or shank to flex transversely, when in use, with less resistance than may be suitable or desirable, while the second portion of the stiffening means causes or assists in causing the fore-part of the sole to return to or towards its normal or unflexed state after it has been flexed transversely in the neighbourhood of the ball of the user's foot.

Preferably the arrangement is such as to avoid the presence of a zone of relatively low resistance to flexure adjacent to and in front of the first portion of the stiffening means. To this end the forward end of the first portion may be integral with or united to the rearward end of the second portion. Alternatively the forward end of the first portion may lie ahead of the rearward end of the second portion so that the first and second portions overlap each other lengthwise of the sole.

The stiffening means preferably comprises one or more preformed components incorporated in a sole body. If there are two or more components they may be made from the same material or from different materials. The component or at least one of the components may be formed as a moulding of a plastics material or the like; an acetal resin may be appropriate or a material loaded with fibres such as glass or carbon fibres. Alternatively the component or at least one of the components may be formed by vacuum-forming.

The first portion is preferably of progressively reduced cross-section towards its forward and so that its stiffness is progressively reduced. The first portion may be relatively thick to ensure the necessary stiffness in which case it may be solid or of longitudinally grooved or corrugated form so as to reduce the quantity of material used in its construction.

The second portion may be thinner than the first portion and may comprise two or more elements which are laterally spaced apart and extend generally lengthwise of the fore-part of the sole. The elements are preferably joined together at or near their forward ends.

The sole body is preferably moulded around the stiffening means and may be formed from a plastics material or a similar material which is wear-resistant and flexible. Polyurethane is a suitable material. The arrangement may be such that the stiffening means and the sole body adhere to each other or become bonded to each other but that is not essential and the arrangement may be such that the stiffening means and the sole body are so shaped that they interengage one another and so remain in engagement without reliance on their being adhesively interconnected or being bonded together. Interengagement may be effected by providing holes or other openings in the stiffening means which are entered by the sole body as the latter is formed so as to resist relative movement between the sole body and the stiffening means.

The first portion of the stiffening means is preferably visible from the underside of the sole so as to provide a visible indication of its presence to the user or purchaser. Similarly, at least a part, that preferably being a forward part, of the second portion of the stiffening means is preferably visible from the underside of the sole. Either or both of those portions may be visible through an aperture in the sole body or may be visible through a transparent or translucent window in the sole body. Alternatively, or in addition, the sole body or at least part thereof may be made of transparent or translucent material so that it reveals the presence of the stiffening means to a user or purchaser.

Figure 1:
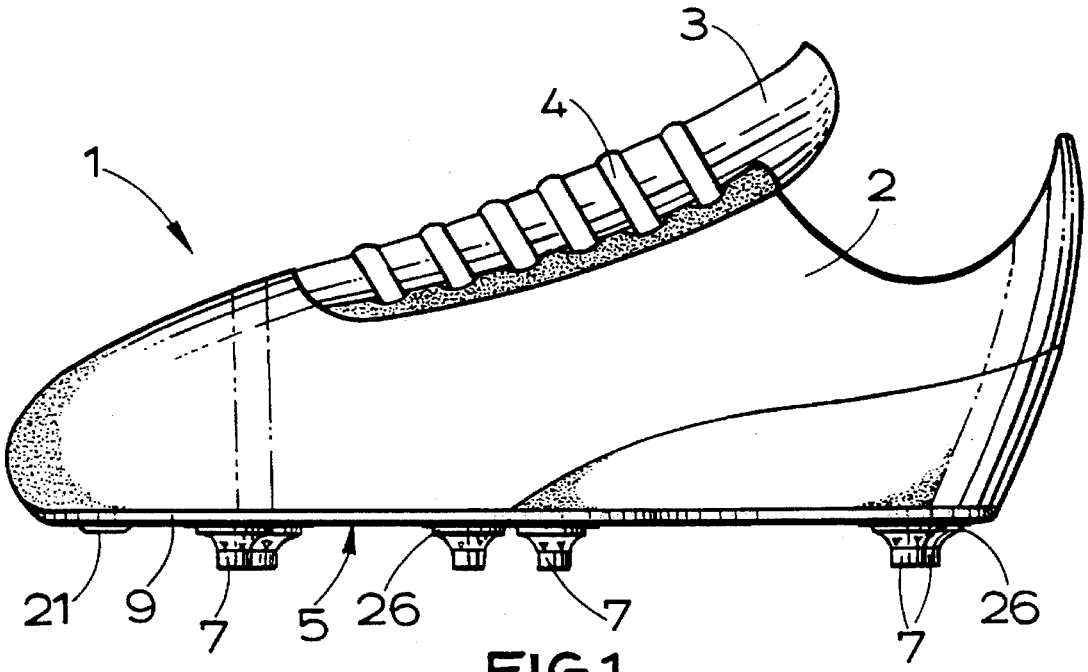
FIG. 1 is a side view of a soccer boot (i.e. a boot for use in playing Association Football), with studs, embodying the present invention.
Figure 2:
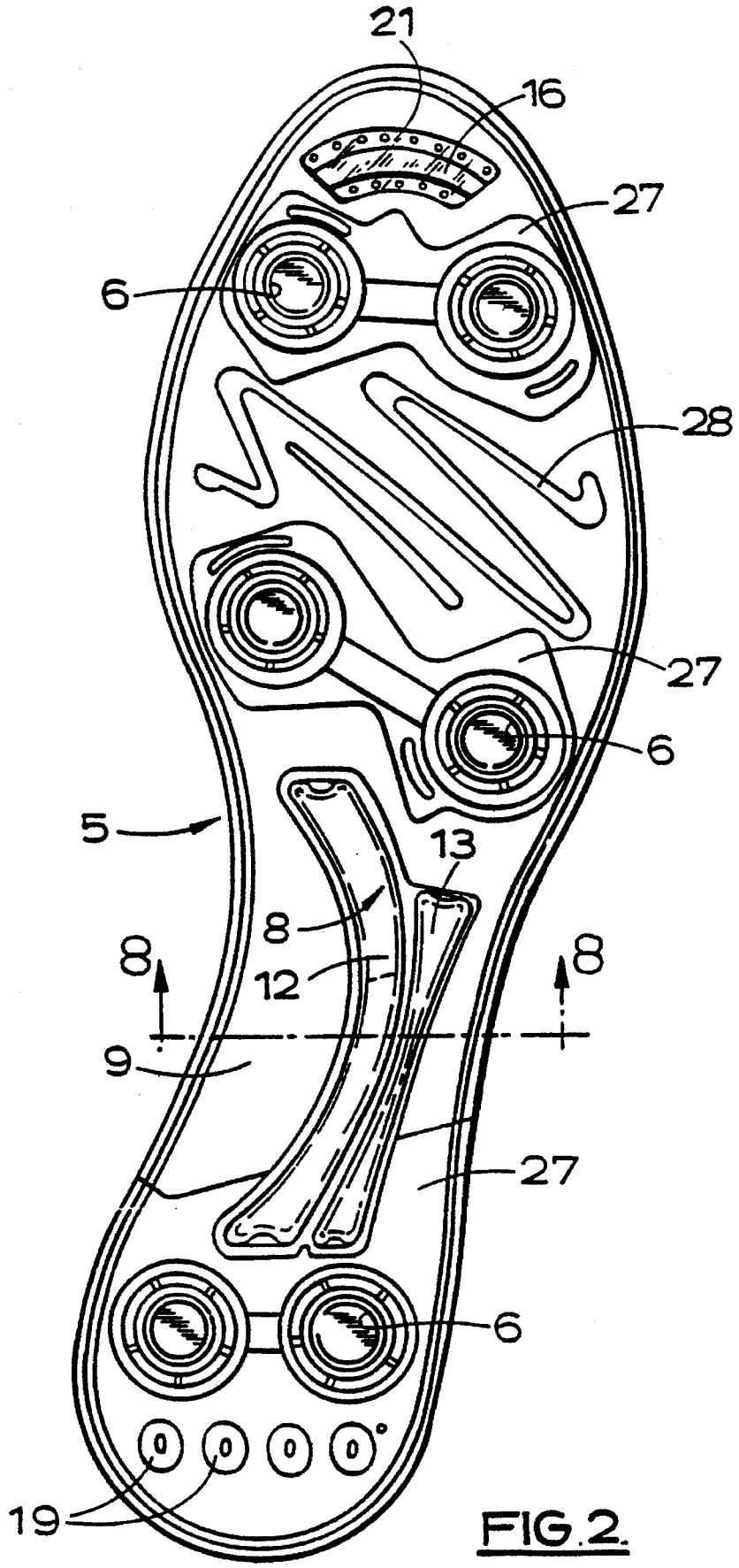
FIG. 2 is a view from beneath and to a larger scale of a sole embodying the present invention and incorporated in the soccer boot shown in FIG. 1.
Figure 3:
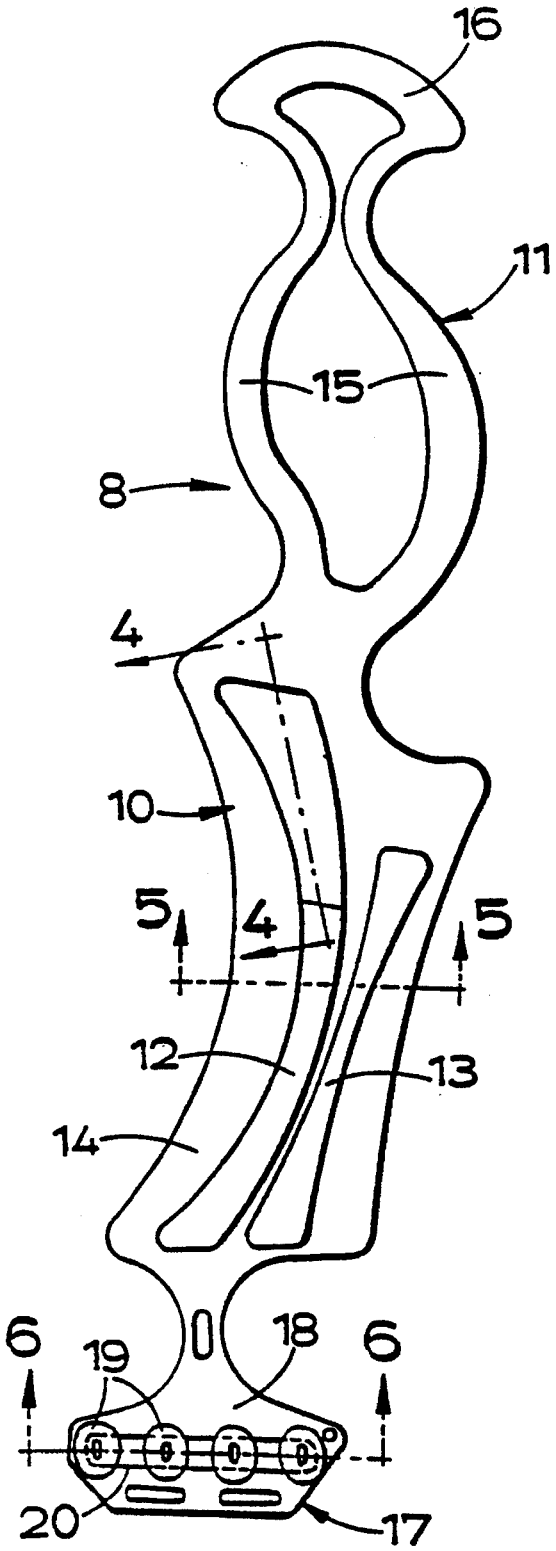
FIG. 3 is a view from beneath of stiffening means similar to that incorporated in the sole shown in FIG. 2.

DESCRIPTION OF PREFERRED EMBODIMENTS OF THE INVENTION:

The soccer boot 1 shown in FIG. 1 is of generally conventional form, apart from the sole, and will therefore not be described in detail. The boot has an upper 2 made of leather or similar material and is provided with a tongue 3 and lace 4. The boot has a sole 5 of composite construction and an insole (not shown) between which are sandwiched marginal portions of the upper 2, which are tapered in thickness or "feathered" in the usual manner. The sole incorporate a plurality of internally screw-threaded sockets 6 (see FIG. 2). Ground-engaging studs 7 have upwardly projecting spigots (not shown) which have complementary external screw-threads, and each spigot is screwed into an associated one of the sockets to secure the stud in place.

Figure 4:
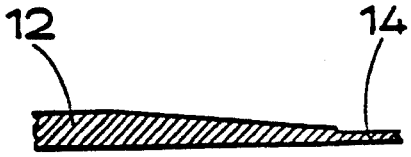
FIG. 4 is a section, to a larger scale, along the line 4—4 of FIG. 3.
Figure 5:
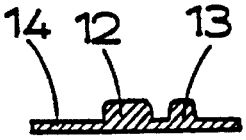
FIG. 5 is a section along the line 5—5 of FIG. 3.
Figure 6:
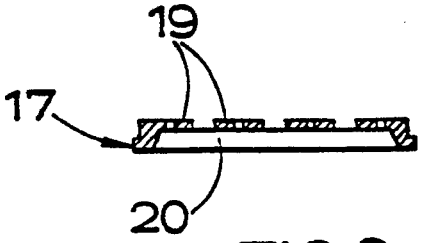
FIG. 6 is a section along the line 6—6 of FIG. 3.
Figure 8:
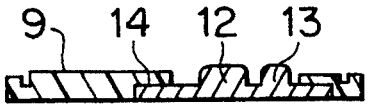
FIG. 8 is a cross sectional view taken generally along line 8—8 of FIG. 2.

The sole 5 comprises stiffening means 8, shown in detail in FIGS. 3 to 6 inclusive, and a body 9. The stiffening means 8 comprises a unitary moulding of a tough, flexible and resilient material such as an acetal resin; a suitable resin is marketed by Dupont (U.K.) Limited under the trade mark DELRIN. The upper surface of the stiffening means is planar. The stiffening means includes a first portion 10 and a second portion 11. The first portion 10 includes a pair of longitudinally extending ribs 12 and 13 which are thicker than a surrounding web 14 and project downwards from the web. The ribs of the first portion 10 of the stiffening means render the first portion sufficiently stiff to prevent that portion flexing transversely more than to a small extent in normal use. The rear ends of the ribs are mutually aligned transversely of the stiffening means but at their forward ends the rib 12 extends forwards beyond the rib 13 so that the rigidity of the forward end part of the first portion 10 is less than that of the remainder of the first portion. Furthermore, the forwardly projecting part of the rib 12 is tapered in thickness, as indicated in FIG. 4, so that its stiffness is progressively reduced towards the front end of the first portion. In an alternative construction (not illustrated) the ribs 12 and 13 are formed with longitudinal grooves opening upwards; in this way the thickness of the stiffening means can be made more uniform over the whole of its extent. In a modification the first portion is of generally corrugated shape, the corrugations extending lengthwise of the stiffening means; this again enables the thickness of the moulding to be made more uniform.

The second portion 11 of the stiffening means is of uniform thickness similar to that of the web 14. It comprises two elements 15 which extend forwards from the web 14 and are interconnected by an arcuate portion 16 at their forward ends. The elements are of sinuous outline, as shown, in order to accommodate the sockets 6. The elements are of a thickness such that they can be flexed relatively readily but they are resilient so that they have a relatively strong tendency to return to their unstressed, flat state when free from stress.

At the rear of the stiffening means is a tail portion 17 which comprises a web 18 which is a rearward extension of the web 14 and is shaped to accommodate the rearmost pair of sockets. Symbols 19 project downwards from the web 18 adjacent to the rear end of the tail portion. The symbols illustrated are four zeros, but it is envisaged that in practice the symbols could provide identification or other information; for example they could constitute letters spelling a trade name for the boot or the name of the boot's maker. The provision of a transverse groove 20 above the symbols avoid any undue thickness in this zone of the stiffening means.

In manufacture, the stiffening means is preformed and is mounted in a mould for the sole body 5, together with the preformed sockets 6 and an arcuate insert 21 of a transparent material which lies beneath the arcuate portion 16 of the second portion 11 of the stiffening means. Material for the formation of the sole body is then injected into the mould. The material used is flexible and wear-resistant, polyurethane being a suitable material. Pvc could be used for less expensive and less durable boots. Alternatively a material comprising rubber or synthetic rubber may be used. Metallic or coloured material may be used in parts of the mould, if desired, so that they become incorporated in the sole body and enhance the appearance of the sole.

The completed sole is incorporated in the boot in a conventional manner and studs are screwed into the sockets. When a prospective purchaser inspects the boot he or she will see the projecting ribs 12 and 13 and will also see both the arcuate portion 16 at the front and the symbols 19 at the rear which will indicate that the stiffening means extends substantially the full length of the sole. In a modified construction the sole body 9 is made of a transparent or translucent material to enable the whole of the stiffening means to be seen. In that case the insert 21 may be omitted.

The stiffening means is so located in the mould that its flat upper surface is flush with the upper surface of the sole body. Some of the sole material may spread over part of the upper surface of the stiffening means and there may be some natural adhesion between the stiffening means and the sole body so that the sole tends to remain complete while it is being handled during construction of the boot. Nevertheless the two parts of the sole are not firmly anchored together. The arrangement is such, however, that in use the user's weight tends to press the stiffening means downwards into tight engagement with the sole body while the reactive forces applied by the studs to the sole tend to press the sole body upwards, the result being that the stiffening means tends to remain properly assembled with the sole body. If desired, however, the materials from which the stiffening means and the sole body are made may be so selected that they become adhesively secured together. Alternatively, or in addition, countersunk holes may be formed in the web 14 so that the sole material forms shallow headed pins which positively secure the stiffening means to the sole body.

The manner in which the stiffening means acts in use has largely been described above, but in brief the ribs 12 and 13 render the waist or shank of the sole stiff enough to prevent it yielding in an unwanted manner while the elements 15 provide resilience in the fore-part of the sole. As these properties are imported by stiffening means made from a material which is both stiffer and more resilient than the material from which the sole body is made, the overall thickness of the sole can be kept to a minimum and in general can be less than that of a sole made from the sole-body material but lacking this stiffening means.

When the boot is in use it exhibits some additional features that are of value. The presence of the pair of studs adjacent to the front end of the boot adds local stiffness to the sole and resists a tendency there might otherwise be for the sole to flex transversely at a location in front of the ball of the user's foot. The intermediate pair of studs also adds local stiffness and, being staggered lengthwise of the boot, further assists in ensuring that the fore-part of the sole is most readily flexible, in use, beneath the ball of the user's foot. Finally, the pair of studs adjacent to the rear of the boot also adds local stiffness and assist in stiffening the sole beneath the user's heel.

It sometimes happens in use that a user will put his or her foot down and apply weight to it while it is tilted laterally about the longitudinal centre-line of the sole. When this occurs, lateral forces are applied to the three studs along one side of the boot. As most of the weight tends to be applied adjacent to the heel, the strongest lateral force tends to be applied to the rearmost stud of those three studs. In many existing designs of boots this tends to result in the heel portion of the sole flexing about a longitudinal axis and the stud tilting to an increased extent, thereby tending to tilt the user's foot to a yet more inclined position. In a boot of the kind illustrated, however, the presence of the web 14 extending towards the side edges of the heel portion, adjacent to the rearmost studs, coupled with the stiffness arising from the row of symbols 19 and the ribs 12 and 13, renders the heel portion strongly resistant to flexure about a longitudinal axis and to tilting of the studs relative to the boot as a whole. Likewise, the similar formation of the web adjacent to the middle pair of studs serves to resist the lateral tilting of those studs. The presence of the arcuate portion 16 at the front of the boot also provides some resistance to lateral tilting of the front pair of studs.

The sockets 6 may resemble those that are the subject of GB-B-1 564 903. An alternative design of socket comprises a tubular body which is internally screw-threaded and is open at its lower end and closed at its upper end. An annular flange projects radially outwards from the tubular body at a position intermediate the ends of the body. A plurality of arcuate slots extend through the flange. During the formation of the sole body, some of the material that forms the sole body passes through the slots so that in use it serves to anchor the socket and to resist axial or rotational movement of the socket relative to the sole body. Whatever design of socket is employed, each socket is preferably surrounded by an annular part 26 of the sole body. which projects downwards from the remainder of the sole body. While the undersurface of the remainder of the sole body may be planar, the sole body 9 which is illustrated is formed with areas 27 of increased thickness, which add some stiffness to the sole body, and decorative grooves 28, which increase the flexibility of the sole. The thickened areas 27 may be of a different colour from the remainder of the sole body.

The studs may resemble those that are the subject of GB-B-2 191 079.

Figure 7:
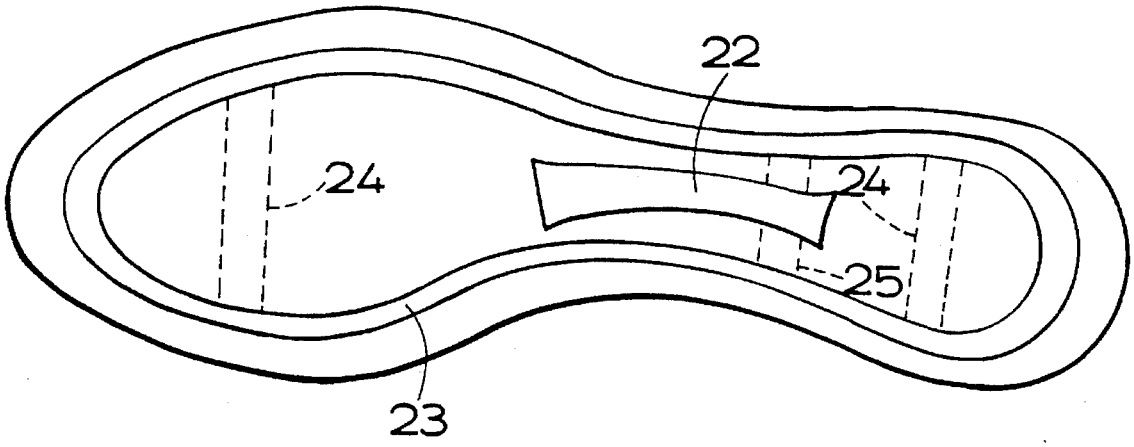
FIG. 7 is a schematic view, from beneath, of an alternative design of sole embodying the present invention.

FIG. 7 illustrates schematically a modified construction in which first and second portions of the stiffening means are separate from each other. The first portion 22 comprises a relatively thick body of elongated shape while the second portion 23 comprises a thinner body in the shape of an endless strip or band which extends around the first portion. The portions may be made of the same material or of different materials. The first body may be longitudinally grooved or corrugated for the same reasons as indicated above. In manufacture the two portions are preformed and the sole body is moulded around them as before. It will be observed that the second portion 23 extends rearwards from the fore-part of the sole and extends alongside the first portion 22. This longitudinal overlap prevents the sole having a zone which is highly susceptible to transverse flexure immediately ahead of the first portion. If desired there may be one or more cross-strips 24 interconnecting the sides of the second portion 23 ahead of and/or behind the first portion.

In a further modification the stiffening means is made as a unitary whole, from a single material, as is the stiffening means 8. But here the interconnection 25 between the first and second parts is behind the front end of the first portion 22 of the stiffening means.

While the foregoing description has referred particularly to soles for soccer boots it will be appreciated that the invention is also applicable to articles of footwear, both with studs and without studs, intended for other purposes. For example the invention can readily be applied to shoes without studs and of the kind referred to as trainers.

I claim:

1. A shoe, which comprises a shoe upper having marginal portions for attachment to an outsole, and a moulded outsole directly secured to said marginal portions which incorporates stiffening means (8;22,23) comprising one or more preformed components (10, 11;22,23) embedded in an outsole body moulded thereabout, the stiffening means having a first portion (10;22) operative to stiffen a waist or shank of the outsole and a second portion (11;23) operative both to stiffen a fore-part of the outsole, though to a lesser extent than the first portion stiffens the waist or shank, and to provide resilience to cause or assist in the return of the fore-part of the outsole to or towards an unflexed state after being subjected, in use, to transverse flexure as the result of flexure of the user's foot at the ball of the foot, characterized in that said moulded outsole body has an upper surface and a bottom surface and is formed with an opening therein between laterally spaced side portions of the waist or shank, and said stiffening means includes a portion projecting downward through said opening and exposed at the bottom surface of said outsole body and an upper surface portion flush with and at least partially exposed at the upper surface of the outsole body and forming a weight-bearing surface.

2. An outsole according to claim 1 in which the forward end of the first portion (10) is integral with or united to the rearward end of the second portion (11).

3. An outsole according to claim 1 in which the first portion (10) is of progressively reduced cross-section towards its forward end so that its stiffness is progressively reduced.

4. An outsole according to claim 1 in which the second portion (11;23) comprises two or more elements (15) which are laterally spaced apart and extend generally lengthwise of the fore-part of the outsole.

5. An outsole according to claim 4 in which the elements are joined together at or near their forward ends.

6. An outsole according to claim 1 in which the outsole body is translucent or transparent.

* * * * *